US005801598A

United States Patent [19]

Tantawi et al.

[11] Patent Number: 5,801,598

[45] Date of Patent: Sep. 1, 1998

[54] HIGH-POWER RF LOAD

[75] Inventors: Sami G. Tantawi, San Mateo; Arnold E. Vlieks, Livermore, both of Calif.

[73] Assignee: Stanford University, Stanford, Calif.

[21] Appl. No.: 845,986

[22] Filed: May 1, 1997

Related U.S. Application Data

[60] Provisional application No. 60/016,623 May 1, 1996, and provisional application No. 60/019,013 Jun. 7, 1996.

[51] Int. Cl.[6] ..... H01P 1/26

[52] U.S. Cl. ..... 333/22 R; 333/81 B

[58] Field of Search ..... 333/22 R, 81 B, 333/208, 242, 248, 251, 253–257

[56] References Cited

U.S. PATENT DOCUMENTS

| | | | |
|---|---|---|---|
| 2,561,130 | 7/1951 | McClellan | 333/254 |
| 3,138,769 | 6/1964 | DeWitt | 333/257 |
| 3,634,783 | 1/1972 | Rooney | 333/22 R |
| 3,772,619 | 11/1973 | Clarricoats | 333/242 |

*Primary Examiner*—Paul Gensler

*Attorney, Agent, or Firm*—Lumen Intellectual Property Services

[57] ABSTRACT

A compact high-power RF load comprises a series of very low Q resonators, or chokes [16], in a circular waveguide [10]. The sequence of chokes absorb the RF power gradually in a short distance while keeping the bandwidth relatively wide. A polarizer [12] at the input end of the load is provided to convert incoming $TE_{10}$ mode signals to circularly polarized $TE_{11}$ mode signals. Because the load operates in the circularly polarized mode, the energy is uniformly and efficiently absorbed and the load is more compact than a rectangular load. Using these techniques, a load having a bandwidth of 500 MHz can be produced with an average power dissipation level of 1.5 kW at X-band, and a peak power dissipation of 100 MW. The load can be made from common lossy materials, such as stainless steel, and is less than 15 cm in length. These techniques can also produce loads for use as an alternative to ordinary waveguide loads in small and medium RF accelerators, in radar systems, and in other microwave applications. The design is easily scalable to other RF frequencies and adaptable to the use of other lossy materials.

10 Claims, 4 Drawing Sheets

HIGH-POWER RF LOAD

CROSS-REFERENCE TO RELATED APPLICATIONS

This application claims priority from U.S. Pat. application No. 60/016,623 filed on May 1, 1996 and from U.S. Pat. application No. 60/019,013 filed on Jun. 7, 1996, which are both incorporated herein by reference.

FIELD OF THE INVENTION

This invention relates generally to high-power radio frequency (RF) loading techniques. More particularly, it relates to compact, dry loads and attenuators having cylindrical cross-sections.

This invention was supported by U.S. Department of Energy grant number DE-AC03-76SF00515. The U.S. Government has certain rights in the invention.

BACKGROUND OF THE INVENTION

High-power RF loads have application in linear accelerator systems, radar systems and other RF-based systems served by the high-power microwave tube industry. For example, the high power radio frequency (RF) system planned for the Next Linear Collider (NLC) contains thousands of places where high power RF loads are required. In some cases, the load must handle 400 MW of peak power for 250 ns. It also must handle an average power of 22.5 kW based on an RF power source of 100 MW for a period of 1.25 μs, and a repetition rate of 180 Hz. The operating frequency is 11.424 GHz. Of course the power could be split into several ports and dissipated into several, low-power loads, but this solution multiplies both the number of loads and the overall cost of the system.

A common method of absorbing high power microwave energy at X-band frequencies is to use water loads in which the water itself is the microwave absorbing medium. These devices are composed of ceramic "pill-box" windows which serve to separate the upstream vacuum environment from the downstream circulating water. The windows have water circulating on the down stream side of the ceramic disk to dissipate the power. At very high power levels, however, there is a danger of damage to the ceramic window due to RF breakdown. If the ceramic window fails it could result in water leaking into the vacuum side of the RF system. Therefore, a vacuum compatible "dry" load is required for high-power applications.

One approach to making a high-power X-band dry load is to use a waveguide loaded with lossy ceramics. Loads of this type, however, are expensive because they require vacuum compatible ceramics. They are also hard to make because of difficulties associated with brazing ceramics to the copper waveguide walls.

Instead of using lossy ceramics one can use a rectangular waveguide made from a lossy conductor. Magnetic stainless steel is a particularly good choice because of its vacuum compatibility, and relatively high RF surface resistivity. The low attenuation constant inherent to rectangular waveguides, however, results in a load that is not able to completely absorb the signal in a short distance. For example, an X-band RF load of this type must be approximately 1.5 m long in order to be useful in high power applications.

One obvious technique to reduce the length of a rectangular load is to spiral the waveguide. Nevertheless, the length of waveguide is only somewhat reduced and requires distributed pumping to guarantee good vacuum. Consequently, the resultant load is heavy and expensive.

Another alternative load design is to match a short length of lossy waveguide, terminated in a short circuit, with a post. Although the resultant load is relatively compact, it has a very narrow bandwidth and does not completely absorb broadband signals.

In summary, conventional, high-power RF loads have one or more of the following problems: bulkiness, excessive length, narrow bandwidth, potential coolant leaks, and high material and fabrication costs.

SUMMARY OF THE INVENTION

In view of the above, it is an object of the present invention to provide an RF load which is at once compact, broadband, reliable, inexpensive, and capable of absorbing very high-power RF signals. These objects and advantages are obtained by a dry RF load comprising a series of very low Q resonators, or chokes, in a circular waveguide operating in the fundamental $TE_{11}$ mode. The sequence of chokes absorb the power gradually in a short distance while keeping the bandwidth relatively wide. The present inventors are apparently the first to recognize that it is possible, even in principle, to design and implement a load of this type which uses a circular, rather than rectangular, waveguide. A polarizer at the input end of the load is provided to convert incoming linearly polarized $TE_{10}$ mode signals to $TE_{11}$ mode (circularly polarized) signals. Because the load operates in the circularly polarized mode, the energy is uniformly and efficiently absorbed. The circularly polarized mode also minimizes hot spots on the wall of the cylindrical waveguide, because it reduces the peak electric field for the same amount of power.

The invention uses a circular polarizer between the rectangular input wave guide and the cylindrical load. The circular polarizer is made up of a section of rectangular wave guide, with suitably chosen lengths of its shorter and longer sides, inserted between, and coaxial with, the input rectangular wave guide and the load, and oriented with its longer side at + or − 45 degrees to the longer side of the input wave guide. The incident RF signal is assumed to be in the commonly used rectangular $TE_{10}$ mode. The inserted rectangular wave guide section is designed to also excite the rectangular $TE_{01}$ mode and allow both the rectangular $TE_{10}$ and $TE_{11}$ modes to be transmitted. Its length is chosen so that by the time these two orthogonal modes reach the junction between its end and the load, the electric field vectors of these two orthogonal modes will be 90 degrees out of phase, setting up the conditions for a circularly polarized $TE_{11}$ mode entering the load. The circularly polarized $TE_{11}$ mode allows the RF energy to be swept along uniformly and, hence, absorbed in like manner in the azimuthal direction about the axis on the wall of the cylindrical load. By avoiding the production of hot spots on the wall of the load, the circular polarizer can further enhance the superior power-handling capability of a compact high-power RF load. This method can also be used with other cylindrical RF loads which support the circular $TE_{11}$ mode and utilize other RF energy absorbing materials and schemes on their walls.

With this load a bandwidth of 500 MHz (VSWR<1.5) can be achieved at X-band with an average power dissipation level of 1.5 kW, and a peak power dissipation of 100 MW. The load is simple (made of just stainless steel), inexpensive, reliable, compact (length less than 15 cm) and can also be used as an alternative for ordinary waveguide loads in small and medium RF accelerators, radar systems, and other microwave applications. The design is easily scalable to other RF frequencies and adaptable with the use of other lossy materials in the circular waveguide. This method of RF absorbtion also finds application to situations where the attenuation of the signal is important. In this case only a fraction of the power is absorbed with the remainder being transmitted.

BRIEF DESCRIPTION OF THE DRAWING FIGURES

FIG. 1A is a cross-sectional schematic diagram of a load according to the present invention.

FIG. 1B is a cross-sectional view of a preferred embodiment. It includes several chokes placed in a circular waveguide. The circular guide is to be operated in the fundamental mode ($TE_{11}$).

DETAILED DESCRIPTION

Although the following detailed description contains many specifics for the purposes of illustration, anyone of ordinary skill in the art will appreciate that many variations and alterations to the following details are within the scope of the invention. Accordingly, the following detailed description is set forth without any loss of generality to, and without imposing limitations upon, the claimed invention.

Figure 1A:
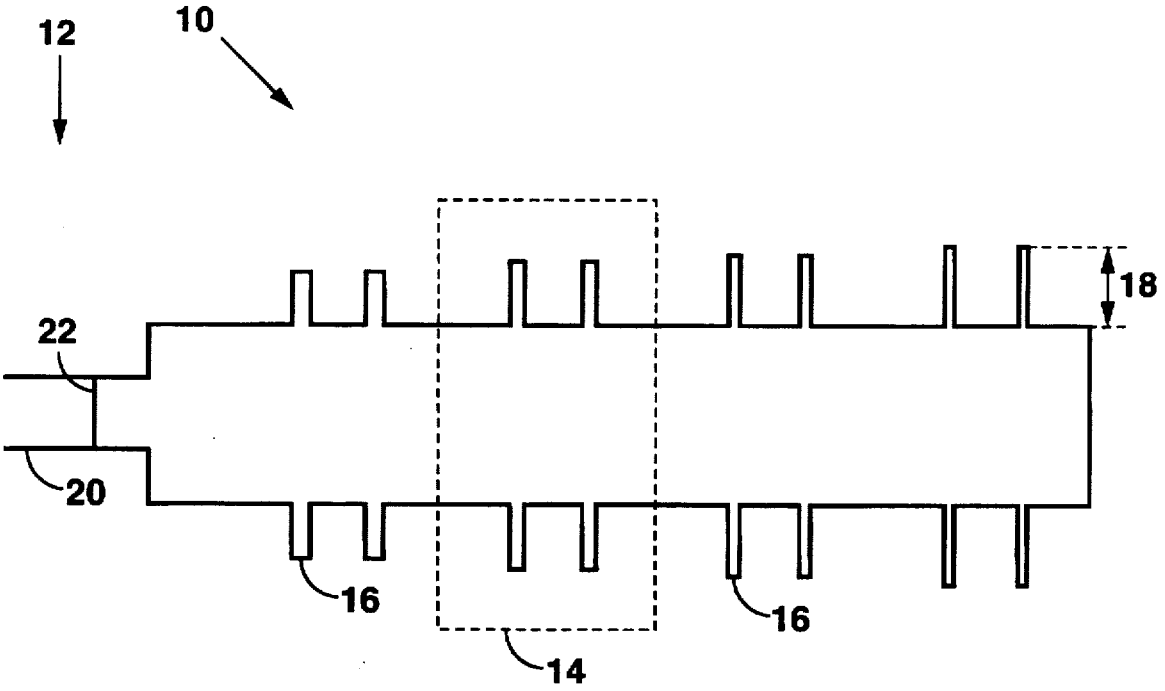
FIG. 1C is a cross-sectional axial view of the polarizing section of the load shown in FIG. 1B.
FIG. 1D is a cross-sectional axial view of the choke section of the load shown in FIG. 1B.

Essential to the present invention is the use of a cylindrical waveguide together with a series of very low Q resonators. FIG. 1A illustrates the basic structure of a load constructed in accordance with the principles of the present invention. The load comprises a choke section 10 and a polarizing section 12. The polarizing section 12 converts incoming $TE_{10}$ mode signals to $TE_{11}$ mode (circularly polarized) signals. The circularly polarized signals then enter the choke section 10 which is a circular waveguide designed to absorb the energy of the signals. The choke section 10 is divided into a number of cells 14, each of which contains a matched pair of chokes 16. The entire load may be produced from lossy metal, such as 430 stainless steel, and has a length of less than 15 cm.

Each resonator or choke 16 is designed with a choke depth 18 of approximately $\lambda/4$, where $\lambda$ is the free space wavelength of the signal to be attenuated by the load. This normally results in a large reflection of RF as well as a significant RF absorption in the choke walls due to the lossy stainless steel. To promote the property of absorption and alleviate the problem of reflection back into the system, groups of chokes are designed so that the net sum of the reflected signal is zero. This is accomplished by an appropriate choice of choke separation. A simple design consists of a pair of chokes grouped in a cell 14, separated by a distance such that the sum of the two reflected signals cancel. This results in a cell 14 with the property that power is either absorbed or transmitted. The present inventors were apparently the first to recognize that it is possible to obtain this matching property in the context of an RF cylindrical waveguide.

Figure 1C:
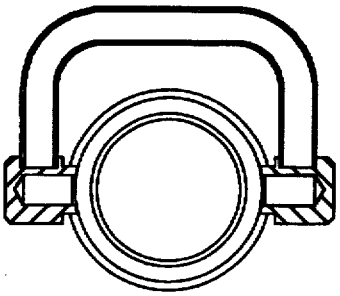
Figure 1D:
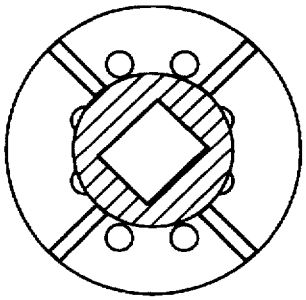
Figure 1B:
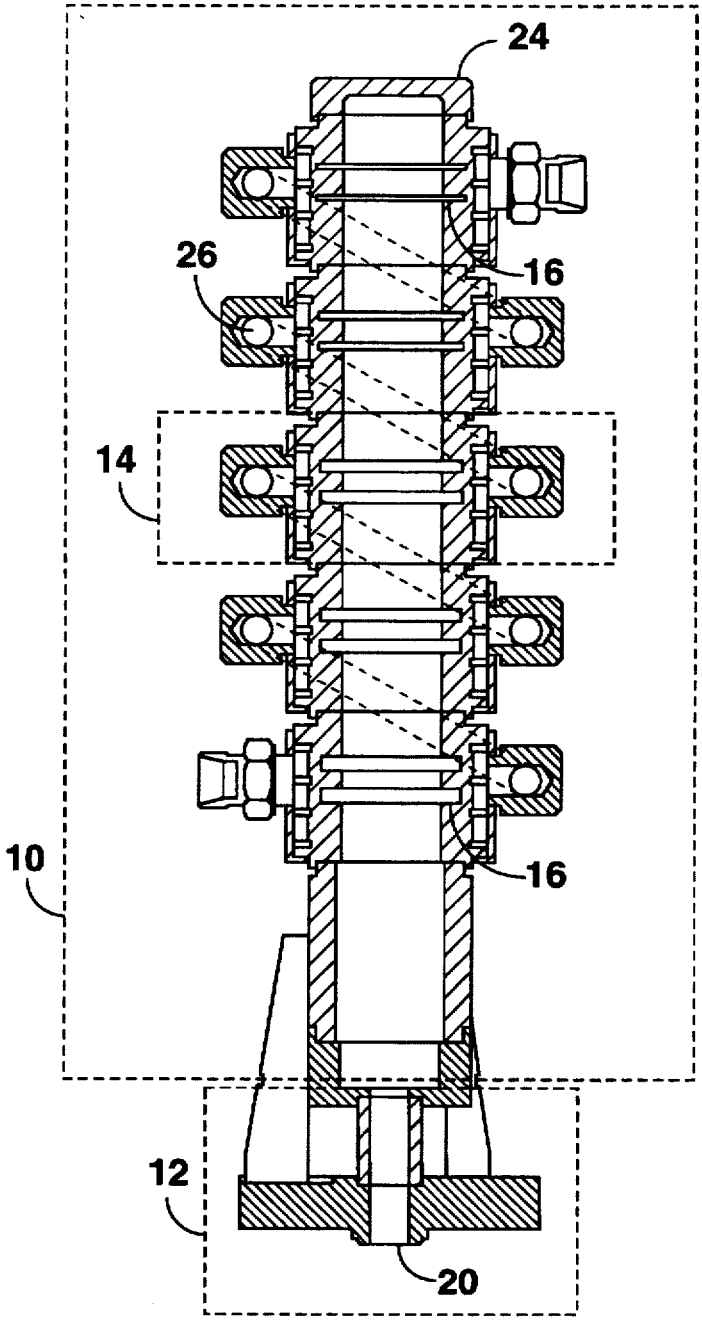

In order to maximize the average and peak field handling capabilities, a load should absorb power uniformly along the axial direction. This means that each cell absorbs the same amount of power as all the others. This "power tapering" of the load is accomplished by an appropriate adjustment of each cell's geometry. For $TE_{11}$ resonators the loss is easily controlled by adjusting the resonator width since the attenuation $\alpha$ of the radial wave can be shown to vary with the width t as $\alpha \sim e^{1/t}$. Some small adjustments to the choke radius and separation is also necessary. (As an example, in a 5-cell load one would design the first cell to absorb 20% (1/5) of the incoming RF, the second 25% (1/4) of its incident power, the third 33% (1/3), the fourth 50% (1/2) and the fifth 100%). As shown in FIG. 1B, the choke section 10 of the load is terminated by a short circuit element 24. A tube 26 spiraling around the outside of the load carries circulating water which is used to dissipate the power absorbed by the load.

In order to further improve its effectiveness and efficiency, the present invention provides for a load with additional advantageous properties. First, it is desirable to have a device that is not overmoded so as to prevent the introduction of spurious modes which may not be as readily absorbed. Second, the load should absorb power uniformly in the azimuthal direction to improve its compactness. One can absorb more power per unit length if the power absorption has no azimuthal hot spots.

In order to satisfy the first condition above, the circularly polarized $TE_{11}$ mode is chosen. Since this is the lowest circular mode there is always a minimum radius where no other modes can propagate. In applications where the RF is initially transported in a rectangular guide, e.g. in a $TE_{10}$ mode, the mode conversion to the $TE_{11}$ mode in a circular guide would normally result in polarization of the electric field in the same direction as the field in the rectangular guide (i.e. parallel to the narrow wall of the guide). In order to satisfy the second condition above and permit power to be absorbed in the choke uniformly, a polarizer 12 is introduced coaxially into the design between the rectangular guide and the circular load section 10. This polarizer 12 comprises a length of rectangular guide whose dimensions are chosen so that the RF can propagate in both transverse axes (i.e. such that both the $TE_{01}$ and $TE_{10}$ rectangular modes are above the cutoff frequency). This rectangular polarizing guide is oriented with its rectangular walls rotated by 45 degrees with respect to those of the initial rectangular guide so that the power of the $TE_{10}$ mode is split evenly by the polarizer into two orthogonal $TE_{01}$ and $TE_{10}$ modes. The transverse dimensions of the polarizer are unequal, resulting in different phase velocities for the $TE_{01}$ and $TE_{10}$ modes. The length of the polarizer is chosen so that there will be a phase difference of 90 degrees between the two modes at the downstream end of the polarizer, at the entrance of the circular load. The conversion of these two modes into a $TE_{11}$ mode in the circular guide will therefore result in a $TE_{11}$ mode whose electric field rotates in time, i.e. a $TE_{11}$ circularly polarized mode. This permits a uniform absorption of power azimuthally in the circular choke section 10.

If there are no losses and the chokes 16 are tuned near their resonant frequency (i.e. the choke depth 18 is $\sim\lambda/4$), each choke would have a very high reflection coefficient. However, since the structure is made from 430 stainless steel, there are considerable amounts of wall losses. Hence, each choke couples a considerable amount of power to the next one. On average, each choke has a transmission coefficient that more or less is equal to its reflection coefficient. By adjusting the distance between two chokes it is possible to match the pair. Each load cell 14 contains such a matched pair. By proper design we can adjust each cell so that the power dissipated per cell is a constant. The input to the circular guide is matched to a standard WR90 rectangular guide 20 using an inductive tuning post 22. This type of junction has a relatively large bandwidth; hence, it is not a limiting factor on the load bandwidth.

To facilitate understanding the principles of the load design according to the present invention, consider a portion of the circular waveguide around a choke 16 as a three port network with the third port terminated in a short circuit. Define ports one and two as the circular waveguide ports and port three as the radial waveguide choke 16. If we initially assume that this is a lossless structure, then the scattering matrix S representing the structure is unitary and we can write $$S=\begin{pmatrix} \sin^2\left(\frac{\theta}{2}\right) & -\cos^2\left(\frac{\theta}{2}\right) & \frac{\sin\theta}{\sqrt{2}} \\ -\cos^2\left(\frac{\theta}{2}\right) & \sin^2\left(\frac{\theta}{2}\right) & \frac{\sin\theta}{\sqrt{2}} \\ \frac{\sin\theta}{\sqrt{2}} & \frac{\sin\theta}{\sqrt{2}} & \cos\theta \end{pmatrix};$$

where θ is a parameter that completely defines the scattering matrix. The scattered RF signal vector $V^-$ is related to the incident RF signal vector $V^+$ by $$V^-=SV+;$$

where the signal vector components $V^{\pm}_i$ represent incident/reflected RF signal from the $i^{th}$ port. We terminate the third port so that all the scattered power from that port is completely reflected; i.e., $V^+_3=V^-_3e^{i\psi}$.

To account for losses in the choke, we write $$V^+_3=V^-_3\alpha e^{i\psi}$$

where α is the attenuation suffered by the radial wave during its round trip through the choke. One can show that $$\alpha^2=\exp\left\{\frac{2R_s}{0.637Z_0k_0t}\int_{k_0r_i}^{k_0r_0}[J_0^2(\rho)+J_2^2(\rho)+Y_0^2(\rho)+Y_2^2(\rho)]\rho d\rho\right\}\times(1-\Delta)$$

Here, Ji(ρ) and Yi(ρ) are the first and second kind Bessel functions of order i, $R_s$ is the RF surface wall resistance, $k_0$ is the wave propagation constant in free space, $r_i$ and $r_o$ are the inner and outer radii of the choke, t is the choke thickness, $Z_0$ is the free space wave impedance, and the factor (1-Δ) accounts for the end wall losses. The term Δ is $$\Delta=[(J_0(r_0k_0)-J_2(r_0k_0))^2+(Y_0(r_0k_0)-Y_2(r_0k_0))^2]\frac{R_sr_0k_0}{0.637Z_0}$$

The reflection coefficient and transmission coefficients are then given by $$R=\frac{(\alpha e^{i\psi}+1)\sin^2(\theta/2)}{1-\alpha e^{i\psi}\cos(\theta)},$$

-continued $$T=\frac{(\alpha e^{i\psi}-1)\cos^2(\theta/2)}{1-\alpha e^{i\psi}\cos(\theta)};$$

and $$e^{i\psi}=-\frac{H_1^{(2)}(r_0k_0)H_1^{(1)}(r_ik_0)}{H_1^{(1)}(r_0k_0)H_1^{(2)}(r_ik_0)}$$

where $H^{(i)}_1$ is the Hankel function of kind i and first order.

Finally, following the arguments known in the art (see R. E. Collin, "Field Theory of Guided Waves," Ch. 7, Sec. 7.3. McGrow Hill Inc, New York, 1960), we can show that $$\sin(\theta)\approx(k_0t)^{3/2}\left(1-\left(\frac{1.841}{r_ik_0}\right)^2\right)^{1/4}|H_1^{(2)}(r_ik_0)|$$

Using the above theory, one can determine the basic design dimensions for a load to be used in any given application. The dimensions may be further refined using a mode matching algorithm, such as Mlego. In this technique the structure is divided into several circular waveguides along the axial direction. The fields in each section are expanded in terms of circular waveguide modes. In finding these modes one assumes that the waveguide has a constant wall impedance $Z_s$ given by $$Z_s=\left(\frac{\omega\mu_0\mu_r}{2\sigma}\right)^{1/2}(1+j)$$

where σ is the conductivity of the guide walls, and $\mu_r$ is the relative permeability of the walls. The properties of these modes, such as their orthogonality, are known in the art (e.g. see S. F. Mahmoud, "Electromagnetic Waveguides Theory and Applications," Peter Peregrinus Ltd., 1991).

One matches the fields along the cross-sectional area between different waveguide sections, and requires that the field on the walls along these cross-sectional area satisfy the above equation for $Z_s$.

Figure 2A:
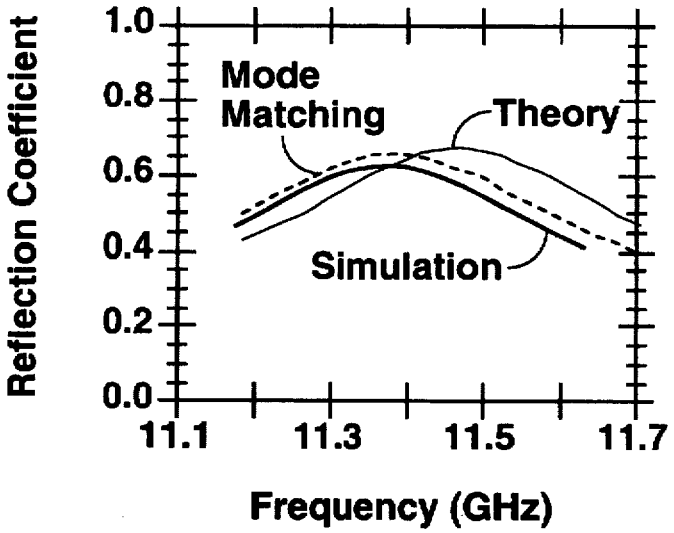
FIG. 2A is a graph comparing theory and different simulation methods for the reflection coefficient of single choke.
Figure 2B:
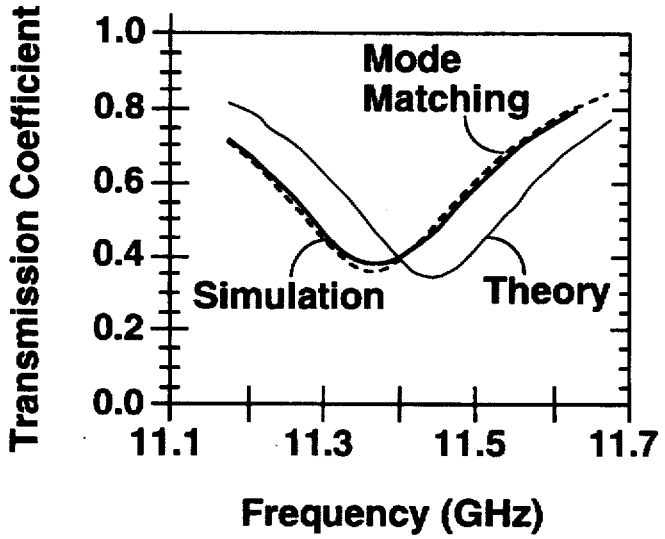
FIG. 2B is a graph comparing theory and different simulation methods for the transmission coefficient of single choke.

FIGS. 2A and 2B compare the reflection and transmission coefficients found from the theoretical mode matching technique discussed above with the coefficients found from known simulation methods. As shown, the two models agree well. Both graphs are for a single choke having a thickness t=0.040 inches (0.10 cm), an inner radius $r_i$=0.5 inches (1.27 cm), and an outer radius $r_o$=0.755 inches (1.92 cm). Because the computational time required for simulation is very large, it is not feasible to determine optimal load design dimensions without the use of the theoretical model developed above.

Figure 3:
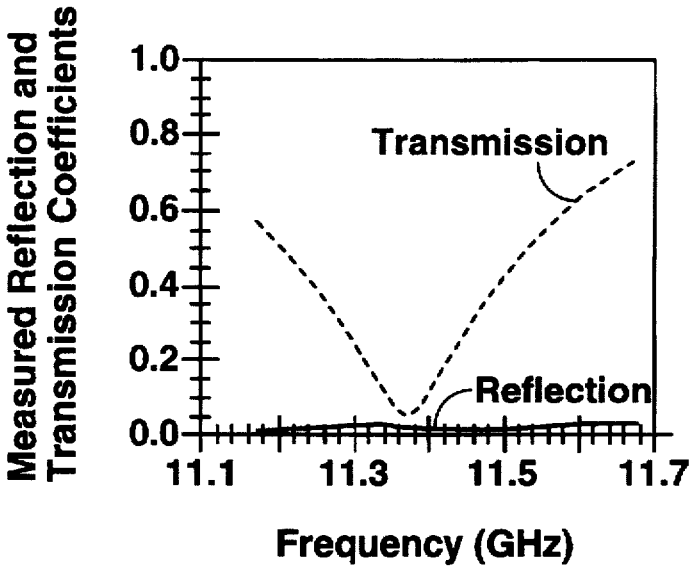
FIG. 3 is a graph showing experimental results of a matched pair of chokes.

Based on results from the mode matching model, a matched pair of chokes is built for the particular application. In a preferred embodiment of a load designed for use in a linear accelerator, he distance between the centers of the two chokes is 0.310 inches (0.787 cm), and the two chokes have the same dimensions as those of FIGS. 2A and 2B. FIG. 3 shows measured values of both the transmission and reflection coefficient of this matched choke pair.

Figure 4:
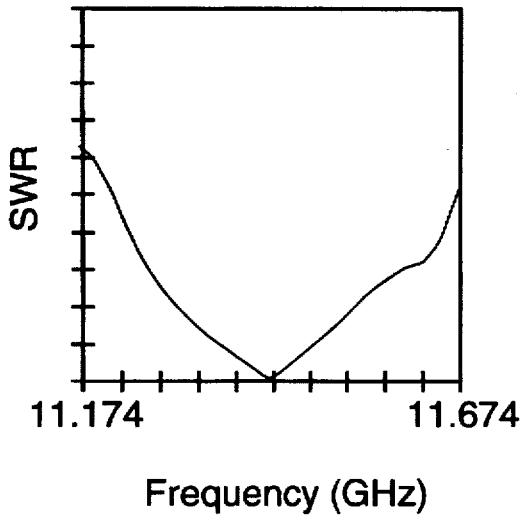
FIG. 4 is a graph presenting the characteristics of a load made of four cells as shown in FIG. 1A.

In this embodiment of a load, four cells are connected together as shown in FIG. 1B. An axial view of a choke pair cell is shown in FIG. 1C. The choke section is connected to a rectangular waveguide junction matched with a post. The polarizer section feeds the RF signal to the choke section through the rectangular waveguide junction. An axial view of the rectangular waveguide junction is shown in FIG. 1D. FIG. 4 presents the measured SWR characteristics of such a load. Note that for SWR<1.5 the bandwidth is greater than 400 MHz.

It will be appreciated by those skilled in the art that the above teaching discloses the techniques needed to design, make and use a compact broad band RF load for high power applications. The load is dry, compact and capable of dissipating 100 MW of peak power. Moreover, the load has a bandwidth greater than 300 MHz at X-band. In addition, the load can be used as an alternative to ordinary waveguide loads in more common microwave applications. Those skilled in the art will appreciate that the same design can be applied for operations in other frequency bands and with the waveguide made of other vacuum-compatible, lossy metals or alloys. Magnetic stainless steel is of course not the only choice of lossy material. Other cheaper stainless steels such as 304 SS could also be used. 304 SS has the advantage in that its thermal properties more closely match copper so that a thin layer of SS could be more easily brazed or sputtered onto a copper substrate providing both an effective lossy material and good heat conductor. Its chief disadvantage is that it is not as lossy as magnetic stainless steel. Those skilled in the art will also appreciate that the techniques of the present invention may be applied to situations where the signal is to be attenuated and not necessarily completely absorbed. In such cases, a portion of the signal passing through the sequence of chokes is then transmitted into a subsequent waveguide rather than being absorbed in a terminating short circuit.

We claim:

1. A radio frequency load for absorbing RF signals, the load comprising a cylindrical waveguide composed of a metallic material, and a sequence of low-Q circular chokes for absorbing RF power, wherein the chokes are positioned coaxially within the circular waveguide, wherein each of the chokes has a resonator width, and wherein the resonator widths of the sequence of chokes decrease such that power is absorbed uniformly by the sequence of chokes.

2. The load of claim 1 further comprising a polarizer connected to an input end of the circular waveguide and adapted to convert a linearly polarized mode into a circularly polarized mode.

3. The load of claim 2 wherein the linearly polarized mode is a $TE_{10}$ mode or a $TE_{01}$ mode, and wherein the circularly polarized mode is a $TE_{11}$ mode.

4. The load of claim 2 wherein the polarizer comprises a rectangular waveguide whose side walls are oriented at 45 degrees with respect to an input rectangular waveguide.

5. The load of claim 1 wherein each of the circular chokes has a choke depth of approximately $\lambda/4$, where $\lambda$ is the free space wavelength of a signal to be attenuated by the load.

6. The load of claim 1 wherein the sequence of circular chokes comprise adjacent matched pairs, and wherein each pair has dimensions that minimize radio frequency reflection from the pair.

7. The load of claim 6 wherein the adjacent matched pairs are adapted to absorb approximately equal amounts of power.

8. The load of claim 1 wherein each choke acts as a very low Q resonator.

9. The load of claim 1 further comprising a short circuit element connected to an output end of the circular waveguide.

10. The load of claim 1 wherein the metallic material is stainless steel and the axial length of the load is less than 15 cm.

* * * * *